United States Patent [19]

Barbour

[11] 4,437,404

[45] Mar. 20, 1984

[54] ELECTRIC DATA RECORDER

[75] Inventor: William P. Barbour, Columbia, Md.

[73] Assignee: DBS, Inc., Randolph, Mass.

[21] Appl. No.: 423,017

[22] Filed: Sep. 24, 1982

[51] Int. Cl.[3] ..... B41F 3/04

[52] U.S. Cl. ..... 101/269; 101/283

[58] Field of Search ..... 101/269, 45, 56, 283, 101/270–274

[56] References Cited

U.S. PATENT DOCUMENTS

| | | | |
|---|---|---|---|
| 3,420,171 | 1/1969 | Maul et al. | 101/269 |
| 3,447,457 | 6/1969 | Dechert, Jr. et al. | 101/269 |
| 3,494,282 | 2/1970 | Gruss | 101/45 |
| 3,540,374 | 11/1970 | Hudson | 101/269 |
| 3,673,960 | 7/1972 | Ricci et al. | 101/269 |
| 3,750,569 | 8/1973 | Janik | 101/269 |
| 3,800,700 | 4/1974 | McInnis et al. | 101/269 |
| 3,916,785 | 11/1975 | Burger et al. | 101/45 |
| 4,085,675 | 4/1978 | Yoshikawa et al. | 101/269 |
| 4,227,453 | 10/1980 | McInnis | 101/45 |

FOREIGN PATENT DOCUMENTS

| | | | |
|---|---|---|---|
| 247096 | 10/1962 | Australia | 101/269 |
| 2163243 | 7/1972 | Fed. Rep. of Germany | 101/269 |
| 2512328 | 9/1976 | Fed. Rep. of Germany | 101/269 |
| 1046358 | 10/1966 | United Kingdom | 101/269 |

OTHER PUBLICATIONS

"Automatic Imprinter", IBM Technical Disclosure Bulletin, vol. 8, No. 2, Jul. 1965, p. 297.

*Primary Examiner*—E. H. Eickholt

*Attorney, Agent, or Firm*—Gerald J. Ferguson, Jr.; Joseph J. Baker

[57] ABSTRACT

An electrically operated data recorder of generally upstanding configuration, bias hinged near the bottom, a gate or side section permitting swinging movement of the hinged section between an open and a closed position. The hinged section serves as a bed of the machine against which a roller platen is designed to act during imprinting of a form from an embossed credit card placed on the bed. The gate is manually moved to the closed position and latched, which energizes an electric motor, setting the roller platen in motion to effect an imprinting operation. When the roller platen reaches the end of the printing stroke, the gate opens, the motor shuts off and is disconnected from driving attachment with the platen moving means. The released roller platen and its moving means are rapidly returned to home position by a spring, and the driving attachment is then reestablished to ready the device for a subsequent operation. In addition, lever means is provided for manually overcoming the latched condition of the gate in case of a jam.

7 Claims, 6 Drawing Figures

ELECTRIC DATA RECORDER

BACKGROUND OF THE INVENTION

Data recorders are currently being used in a wide variety of applications for imprinting various types of forms, documents and the like. In many cases these data recorders include roller platens and are designed for manual operation wherein the operator grasps a platen carriage and causes the roller platen to pass over a form and an embossed printing device such as a credit card lying on the bed of the machine to cause an impression of the data on the printing device to be made on the form.

Data recorders of the foregoing kind have met with a certain amount of success, although the manual operation associated with these machines, and the fact that the same machine is frequently operated by various people during a normal work period, result in non-uniformity in the quality of the printed impressions on the forms. Also, in those cases where the data recorders are utilized for fairly high production by a single operator, the manual actuation of the machines becomes tedious and undesirable.

An electrically operated data recorder which avoids the problems of non-uniformity of impressions and tedious operation implicit in manual operation is disclosed in U.S. Pat. No. 3,420,171. As shown therein, the data recorder comprises a bed section or gate hinged to a base to provide an open-throat for the reception of the embossed card and the form to be imprinted. The roller platen is automatically set in printing motion when the gate is pivoted to closed position against the base and, on completion of a printing stroke, the gate is automatically opened to avoid double imaging of the form as the roller platen is returned to its home position.

The prior art device comprises a drive fork, under constant drive by a motor drive crank, for moving the roller platen through a printing operation. Typically, the roller platen is held at home position at one end of its travel and remains at rest at that position to permit insertion of the credit card and the form when the bed is in the open position. Movement of the bed to the closed position energizes the motor for driving the roller platen from the home position through a printing stroke. However, to insure that the motor driven crank coacting with the drive fork will make only a single revolution during each printing stroke and then be shut off, the prior art device requires fairly complex mechanism which adds to the cost of the machine. Further cost and complexity in the prior device result from the requirement of a clutch or brake associated with the motor to prevent the motor and drive from coasting after the motor has been shut off and carrying the platen beyond the home position and partially into what would ordinarily be the next printing stroke.

The present invention provides a data recorder comprising a simplified mechanism which is less costly to produce, more reliable in operation and easily maintained, and faster acting in operation as compared with the prior art device.

SUMMARY OF THE INVENTION

The present invention provides an electrically operated data recorder in which movement of the swingable gate to the closed position energizes the motor for driving the roller platen from a home position to an actuated position to perform a printing stroke. In response to such a printing stroke, the bed is automatically moved to the open position, the motor is shut off, its driving association with the roller platen self-disconnects, and the roller platen is rapidly returned to home position by a biasing means.

The roller platen drive comprises a motor driven crank coacting with an open-ended slot provided in a drive fork. As the drive fork is rotated in a direction to move the roller platen from the home to the actuated position, the driving of the fork is terminated at a predetermined time corresponding to the arrival of the roller platen at the actuated position in response to the crank exiting from the openended slot in the drive fork. Thus, unlike the prior art device, the present invention does not require complex and costly mechanism to control or limit the crank to a precise single revolution in each printing operation.

Simultaneously with the arrival of the roller platen at the actuated position, the gate is automatically moved to the open position and the motor is shut off. While the motor continues to coast after being shut off, a brake as in the prior art device is not required since the coasting comes to rest prior to the crank's drivingly reengaging a side of the openended slot of the fork for return movement of the platen to the home position. Also, to increase the operating speed of the machine, the fork is spring biased to quickly return the roller platen from the actuated to the home position.

It is an object of the present invention to provide an improved electrically operated data recorder of simplified construction and reduced cost over prior art devices.

Another object is to provide a data recorder, so constructed as to avoid the necessity for a mechanical control logic relating to determining motor shaft position, thereby eliminating the previously reuired sensitive adjustments essential to make such logic effective, whereby increased reliability in operation may be enjoyed and the data recorder may be more easily maintained as compared with prior devices.

Another object of the invention is to provide a data recorder of the foregoing type with a lever means for manually releasing the latched condition of the gate to permit it to be readily opened in case of a jam.

Other objects, features and advantages of the invention will appear hereinafter as the description proceeds.

IN THE DRAWING

Figure 4A:
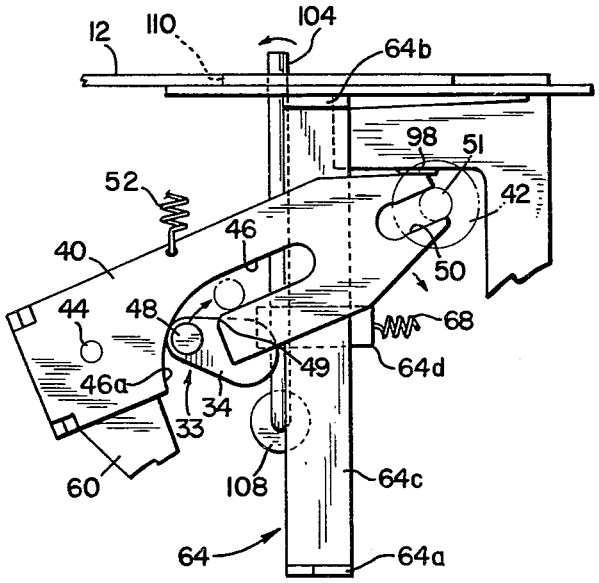
Figure 4B:
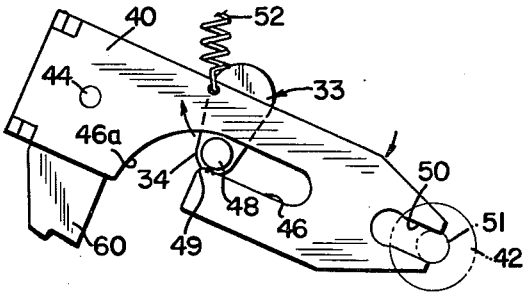
Figure 4C:
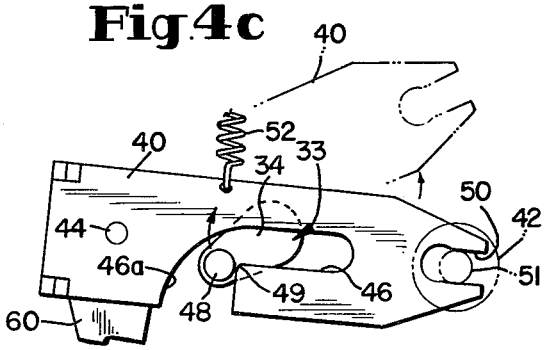

FIGS. 4*a*, 4*b* and 4*c* are fragmentary plan views showing successive positions of the drive means and the roller platen as the operating cycle progresses.

DESCRIPTION OF THE PREFERRED EMBODIMENT

Figure 1:
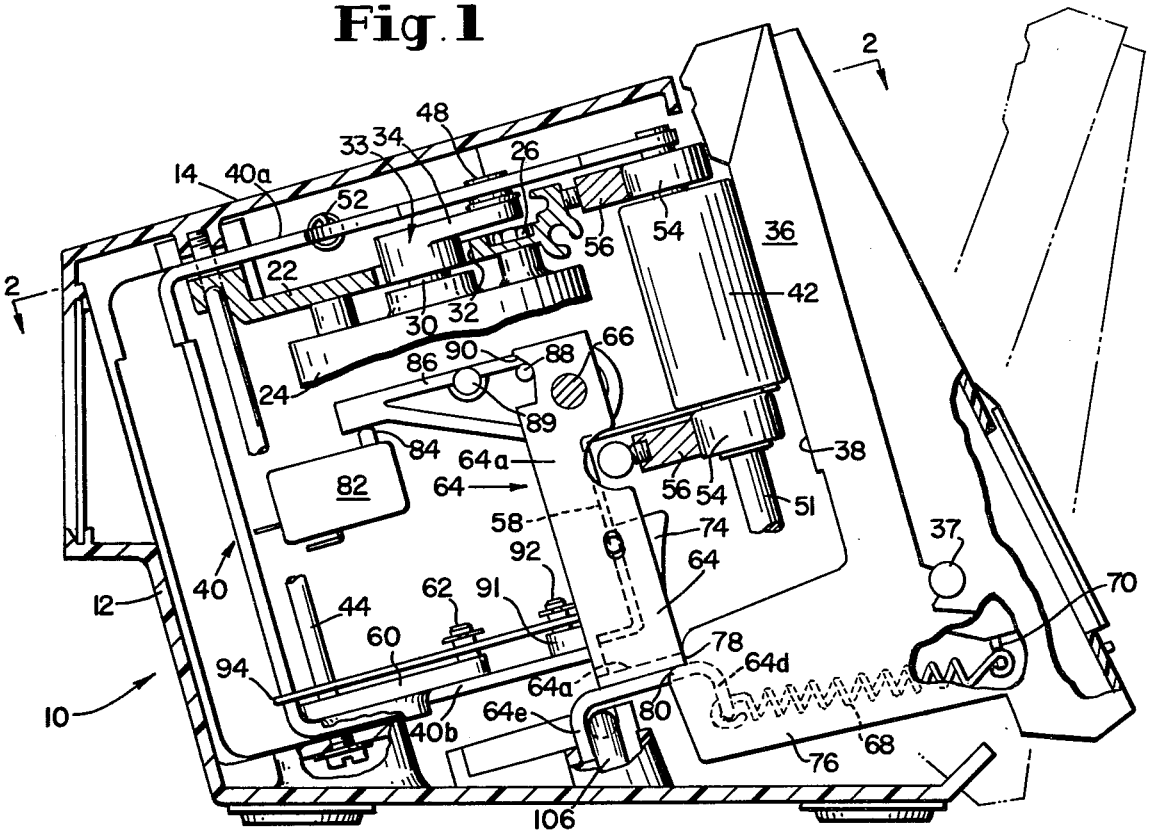
FIG. 1 is a side elevation of an electric data recorder in accordance with the present invention with portions of the frame and housing broken away, and showing the parts as they would appear at the start of a printing stroke with the gate closed and just prior to the start of platen movement, and also illustrating the open position of the gate in broken lines.
Figure 2:
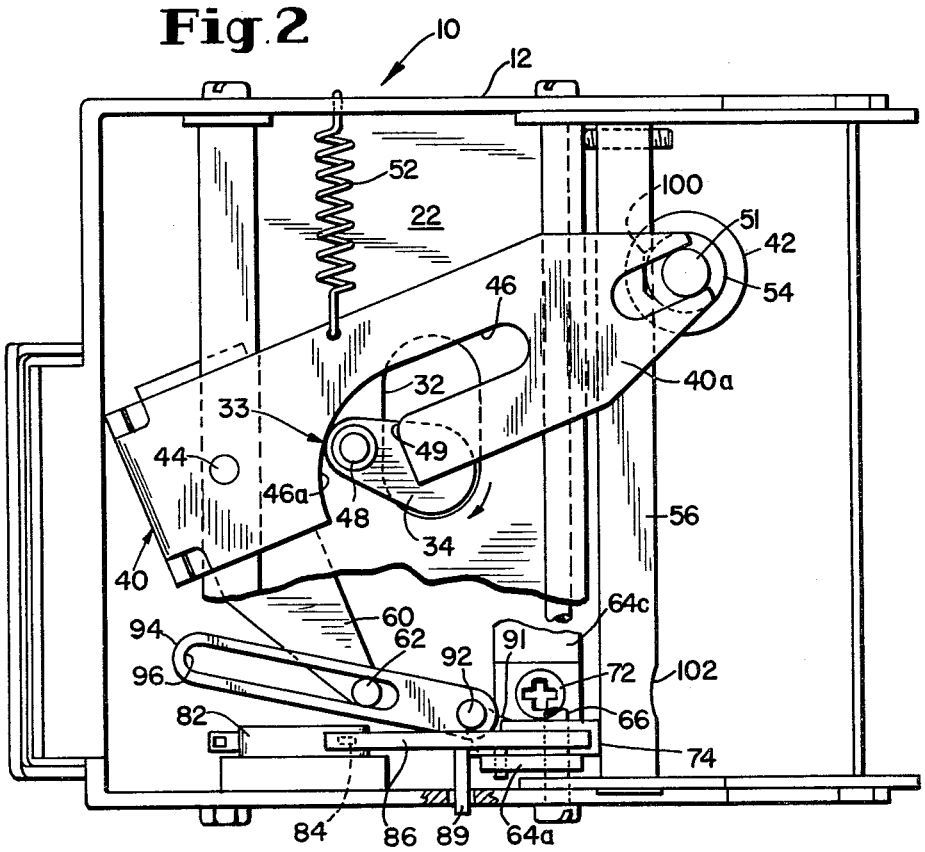
FIG. 2 is an oblique top view of the device of FIG. 1, taken substantially on line 2—2 of FIG. 1, with top portion of the casing deleted, and the gate assembly omitted.

As shown in FIGS. 1 and 2, the electric data recorder is indicated generally by the reference numeral 10, comprising a housing and frame 12, and a cover 14. An auxiliary frame plate 22 (FIGS. 1, 2 and 3) is suitably secured within the upper part of the frame 12 and supports a motor assembly 24 secured to the under surface of plate 22 as by fasteners 26. The motor assembly 24 is of a commercially available type which includes reduction gearing serving an output shaft 30. The output shaft 30 projects upwardly from the motor assembly 24, through a clearance opening 32 provided in the plate 22, and has a crank 33 secured thereon. As viewed in FIGS. 2, 4*a*, 4*b* and 4*c*, the output shaft 30 is adapted to be rotated in a clockwise direction.

A moveable gate on side section 36 is mounted at one side of the data recorder 10 for pivoting movement on a shaft 37 between an open position shown in phantom in FIG. 1 and a closed position shown in full lines in FIG. 1. The gate or side section 36 is the same as the side section fully described and shown in the aforementioned patent and, therefore, will be only briefly described herein. The gate or side section 36 principally comprises a bed 38 for receiving printing elements and forms. The bed is so arranged as to be generally upright in all of its positions and the forms are retained on the bed by gravity in all such positions.

A drive fork 40 of substantially U-shaped configuration is provided for moving a roller platen 42 across the bed 38 in a fixed path from a home position adjacent a first end of the bed as shown in FIG. 4*a* to an actuated position adjacent a second end of the bed as shown in FIG. 4*b*, defining a printing stroke of the roller platen 42. The drive fork 40 is mounted for pivotal movement on a vertical pivot rod 44 as best shown in FIG. 1.

Figure 3:
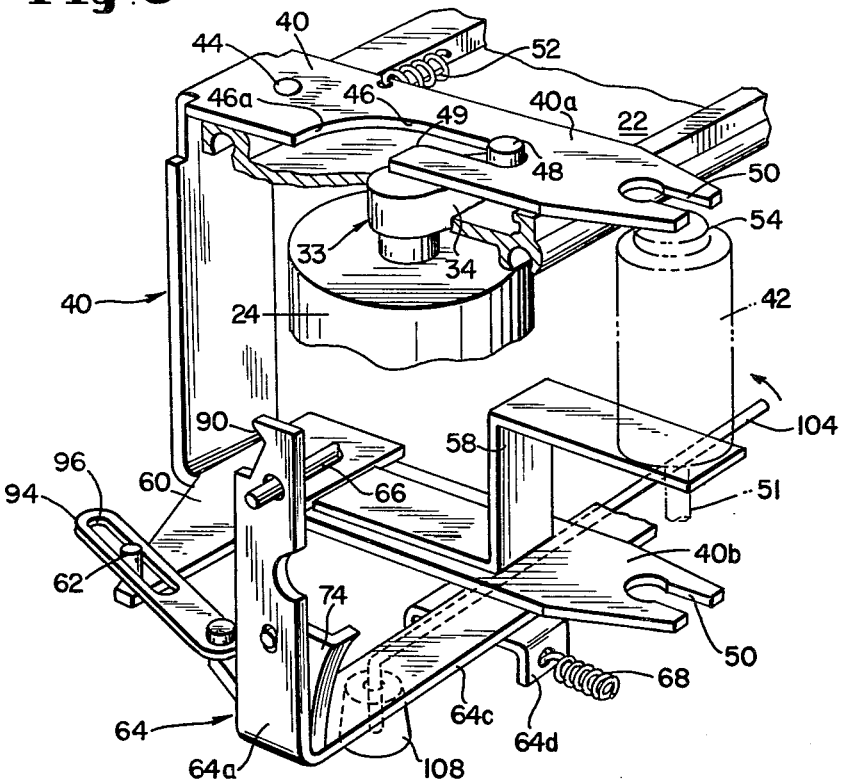
FIG. 3 is a fragmentary perspective view with portions broken away showing the drive means for moving the roller platen through a printing cycle; and with the parts substantially in mid-stroke position.

An upper arm 40*a* of the drive fork 40 is provided with an open-ended slot 46 drivingly associated with the crank 33 which includes a crank arm 34 and an upstanding pin 48 adapted to coact with the open-ended slot 46 to provide controlled movement to the drive form 40. The forward end of the upper arm of the drive fork 40 is bifurcated to afford a slot 50 which receives the upper end of a shaft 51 which carries the roller platen 42. Also, the drive fork 40 is spring-biased toward the home position by a spring 52 as best shown in FIG. 2. The lower arm of the drive fork 40 is also bifurcated to afford a slot 50 which receives the lower end of the platen shaft 51 as shown in FIG. 3.

Above and below the platen 42 on the shaft 51 are rollers 54,54 which run in contact with rails 56,56 which serve to guide the platen roller 42 in its travel across the bed 38, causing it to exert printing pressure against a form thereon. The shaft 51 is provided with a biasing means in the form of a Z-shaped leaf spring 58. This spring 58 is secured at one end to the upper surface of the lower arm 40*b* of the fork 40, and its other end is shaped to embrace the platen shaft 51 at the lower end of the platen 42. The spring 58 is so shaped that when deformed for assembly with the platen shaft 51 it will bias the shaft 51 in a direction to cause continuous contact of the rollers 54,54 with the rails 56,56 whether the gate 36 is open or closed.

Also affixed to the lower arm 40*b* of the fork 40 is a laterally extending arm 60 with an upstanding pin 62 for coacting with a control bail as will be presently explained.

A control bail 64 is pivoted on two stub shafts 66. The bail includes two upright arms 64*a*, 64*b*, (see FIG. 4*a*) and two connecting bars 66. The bail is biased and coacts with gate (37) thru spring 68 and performs the dual function of urging the lower portion of the bail 64 to the right in FIG. 1 (i.e. to active position), and urging the gate 36 towards open position.

Attached to the lower portion of bail 40, as by screw 72 is a deflection guide shoe 74.

Integral with the gate 36 are two arms 76, one at either side thereof, the arm 76 shown in FIG. 1 being the only one appearing in the drawing. Each arm 76 has a notch 78 which coacts with the cross bar of the bail 64 to latch the gate firmly in closed position (as seen in FIG. 1) in condition to receive the imprinting load when the platen roller 42 moves across the bed 38. The near arm 76 in FIG. 1 is lined up with the shoe 74 on the bail and is so constructed that, so long as the gate is unlatched and in any position except fully closed, the nose 80 will be bearing against some portion of the shoe 74, thus holding the bail 64 in its fully leftmost or inactive position.

Mounted on the near side of the machine 10 is a normally open microswitch 82 which includes an actuator plunger 84 and which controls the energization circuit of the electric motor in the motor assembly 24. This plunger is controlled by an actuator arm 86 on one end of which rests upon the plunger 84. The other end of the arm 86 is pivoted on the cross shaft 66 adjacent the upper end of the bail arm 64*a* and includes a laterally extending pin 88 which is so positioned that it can be acted upon by a guide or caming surface 90 on the upper portion of bail arm 64*a* above the pivot 66. It will be seen that when the bail 64 is swung to the right or activating position (as seen in FIG. 1) the camming surface 90 acts to lower the pin 88 so that the distal end of the actuator arm 86 will depress the plunger 84 and energize the motor associated with the motor assembly 24.

When the ball is swung to the left, the camming surface 90 is moved to the right, releasing the pin 88 and allowing the plunger 84 of the microswitch 82 (due to its inherent spring bias) to raise the arm 86 and open the motor circuit.

The arm 86 is also provided with a boss 89 extending horizontally therefrom through a suitable slot in the housing 12. This serves as a handle for manually operating the microswitch 82 via the actuator arm 86 in case of testing or of some emergency situation requiring that the motor be energized to reposition the platen roller 42 of the crank 33.

Associated with the attachment which provides the deflection guide shoe 74 is an integral arm 91 which supports an upstanding pin 92 which pivotally supports one end of a link 94. The link 94 has an elongate slot 96 which receives the pin 62 on the lateral arm 60 of the drive fork 40. The length of the slot 96 is so calibrated that just slightly before the fork 40 reaches the end of the printing stroke, the pin 62 will encounter the outer end of the slot 96 and will draw the bail 64 leftwardly by an amount sufficient to release the arms 76 on the gate 36, allowing the gate 36 to swing to open position under the influence of spring 68. At the same time the upper end of the arm 64*a* of the bail 64 moves slightly to the right so that the camming surface 90 releases the pin 88 thereby deenergizing the motor.

In use, the machine above described operates in accordance with the following description.

The normal position of the parts at rest is shown in FIG. 2 and in FIG. 4*a*, it being understood that the gate 36 is open as shown in dotted lines in FIG. 1. The operator places a credit card and a form on the bed 38 in the customary way and then closes the gate 36 in opposition to the force of the spring 68. At the end of this closing motion, the arms 76,76 (one of which has via shoe 74, been holding the bail 64 in leftward position during rest position) release the bail 64 for slight rightward motion under the influence of spring 68 to the FIG. 1 position, simultaneously latching the gate 36 in closed position by reason of the notch 78 and its coaction with the bottom of the bail 64. This action also cams the pin 90 downwardly closing the microswitch 82, starting the motor to cause the motor assembly to drive the crank 33 in a clockwise direction. This will move the fork 40 clockwise as seen in FIG. 4*a* which causes the roller platen 42 to sweep across the bed 38, thus taking the desired impression. The roller platen 42 moves through the mid position (seen in FIG. 3) and finally arrives at its terminal position shown in FIG. 4*b*. At this time the crank pin 48 has passed down the slot 46 to its end and returned to the FIG. 4*b* position, the crank 33 having moved about 270 degrees from its rest position. At this point it will be noted that the open-ended slot has a configuration such that, with a few more degrees of rotation of the crank 33, the crank pin 48 will be in a position to escape from the slot 46 past a barrier corner 49.

At the same time the pin 62 on the lateral arm 60 of the fork 40 has reached the end of the slot 96 in the link 94 and thereby, with its final increment of movement, moves the bail 64 leftward sufficiently that it releases the arm 76 of the gate 36 and allows the latter to snap open under the influence of the spring 68 while the motor is simultaneously deenergized as previously described. The slot configurations are so arranged that this action occurs simultaneously with or very slightly before the pin 48 escapes the corner 49, at which time the condition will be as illustrated in FIG. 4*c*. It will be seen that the fork 40 is released for motion independently of the crank 33 and is snapped to home position along with the roller platen by the spring 52. Although the motor has been deenergized, the motor rotor and shaft and other parts of the motor assembly 24 continue to coast, roughly 60 degrees of crank motion, until stopped by friction which will cause the crank 33 to come to rest in an approximate home position as indicated in FIG. 4*a*, somewhere midway of an idle arc 46*a* of about 90 degrees extent which constitutes a feature of the throat of the open ended slot 46.

The parts have now reached the initial position previously described in connection with FIGS. 2 and 4*a*, so that the operator merely removes the credit card and imprinted form from the bed 36, and the machine is ready for a subsequent operating cycle when required.

For determining the home position of the fork 40, and for cushioning the blow as it is returned by the spring 52, there is provided a bumper pad 98 mounted on a suitable portion of the machine frame as shown in FIG. 4*a*. It is also noted that there is provided at the proper location in each of the rails 56 a positioning recess 100 which receives the corresponding roller 54 when the fork 40 is in the home position. It is pointed out that in previous machines, as described in U.S. Pat. No. 3,420,171, shallow pressure relief recesses were provided in the rails at each end of the platen stroke to assure proper opening and closing of the gate at these points, and such recesses are shown at the stroke completion end of the rails and indicated by numeral 102 (FIG. 2). The recess 100, however, is significantly deeper than required for pressure relief alone, e.g. perhaps one sixteenth of an inch in depth. While it does indeed act to relieve pressure, the recess 100 also functions to trap the platen at the endmost pressure relief position and prevent its rebounding after its snap motion to home position under the influence of the spring 52, thereby forestalling a possible condition which could prevent closing of the gate 36 by the operator to initiate a subsequent cycle.

In the event that some occurrence should create high loading of the gate 36 which could stall the motor and prevent completion of a printing stroke (for example, if the operator should accidentally insert plural forms) means is provided for readily clearing the jam. In order to release the gate 36 for opening it is necessary to retract the bail 64 from the notches 78 on the arms 76,76 of the gate 36. Under some circumstances it might be possible for the operator to do this directly by tilting the machine, manually engaging the bail through a bottom opening, and thus withdrawing the bail 64 from the notches 78. This, however, is rather inconvenient, and can be difficult to achieve if the gate 36 and platen roller 54 should be wedged tightly enough to create high friction between the bail bar 64*c* and the upward facing surfaces of the notches 78.

The device of the present invention simplifies such an emergency procedure considerably by providing a lever 104, bent on one end to provide a pivot 106 which is received in a socket 108 integral with the bottom of the machine frame 12 (FIGS. 1, 3 and 4*a*). The lever runs parallel to and just beneath the horizontal connecting bar 64*c* of the bail 64 and adjacent the forward or inner face of the ear 64*e* which depends from the bracket secured to the bottom of the bail 64. The distal end of the lever 104 extends through an opening 110 in the frame 12 to a point just outside of the machine in position for manual access. As can best be seen in FIG. 4*a*, the location of the socket 108, the ear 64*e* and the distal end of the lever 104 are so related that by swinging the lever 104 using its distal end as a handle, the bail 64 can be dislodged from the notches 78 in the arm 76 of gate 36 with the benefit of a substantial mechanical advantage, say 3:1, thus providing for ready opening of the gate 36 by the operator in the case of a jam.

What is claimed is:

1. In a data recorder of the type comprising an upstanding main frame, a roller platen carried on the frame, a fork pivoted on the frame arranged to sweep the platen from a home position horizontally through a substantially erect plane printing path and return, a gate including a bed for carrying a form to receive a printing impression, said gate pivotally mounted to swing between an open loading position and a closed printing position, means biasing the gate towards open position, electric motor means for driving said form to sweep the platen through said printing path including a crank engageable in a slot in the fork for driving the same, and switch means for controlling the energization of said motor, the improvement comprising:

means to cause imprinting of said form by said motor means solely during the printing stroke and to then interrupt the said driving connection between the fork and the motor means;

spring means acting on the fork to restore the same to a location placing the platen in home position once the driving connection is interrupted; and means to effect reestablishment of the driving connection in readiness for a subsequent cycle of operation.

2. A data recorder as set forth in claim 1 in which the electric motor means includes an electric motor and a crank continuously drivingly connected and free of any braking control on crank movement whereby crank motion is solely a function of motor energization.

3. A data recorder as set forth in claim 2 in which the slot in said fork has adjacent its open end a throat portion bounded by an idle arc designed to receive the crank in a nondriving manner as it reenters the slot while coasting after the motor has been deenergized.

4. In a data recorder of the type comprising an upstanding main frame, a roller platen carried on the frame, a fork pivoted on the frame arranged to sweep the platen from a home position horizontally through a substantially erect plane printing path and return, a gate including a bed for carrying a form to receive a printing impression, said gate pivotally mounted to swing between an open loading position and a closed printing position, means biasing the gate towards open position, electric motor means for driving said fork to sweep the platen through said printing path including a crank engageable in a slot in the fork for driving the same, and switch means for controlling the energization of said motor, the improvement comprising:

the slot in said form having an open end and being so configured that the crank drives the fork in the printing direction only and then allows the crank to escape from the slot as the platen reaches the end of its printing stroke, spring means for moving the fork in a direction to restore the roller platen to home position when the crank has escaped from the slot;

a control bail pivoted on the frame including means for latching the gate in closed position in response to pivoting of the bail in the opposite direction;

means directly responsive to bail motion for closing said switch in response to bail pivoting in said latching direction and for opening said switch in response to bail pivoting in the release direction;

a lateral arm on said fork; and means connected with said bail and providing an obstruction in the path of said arm, the position of said obstruction being so callibrated as to cause said arm to pivot said bail to non-latching position as the fork reaches the end of its stroke in the printing direction, thereby substantially simultaneously opening said switch and said gate at the time said fork is restored to home position by said spring means.

5. A data recorder as set forth in claim 4 in which the means for closing said switch is an arm pivoted coaxially with said bail, and which includes cam means on said bail coacting with a projection on said arm.

6. A data recorder as set forth in claim 4 in which the obstruction providing means connected with said bail is a link formed with an elongate slot and pivotally supported at one end on said bail, and in which the arm includes a pin projection riding in said slot.

7. A data recorder as set forth in claim 4 in which there is a bumper pad so located as to arrest the fork at home position upon its return by said spring means, in which the roller platen is guided in its traverse of the bed by rails parallel to the bed, in which the platen is associated with rollers which run in contact with said guide rails, and in which said rails each exhibit a recess adjacent the home position of said platen for receiving said rollers and of a depth sufficient to prevent rebound of said fork when stopped by said bumper pad upon return of the platen by said spring means.

* * * * *